United States Patent [19]

Rhee

[11] 3,934,271

[45] Jan. 27, 1976

[54] PROTECTIVE HELMET

[76] Inventor: Jhoon Rhee, 2525 N. Ridgeview Road, Arlington, Va. 22207

[22] Filed: Nov. 27, 1974

[21] Appl. No.: 527,910

[52] U.S. Cl. ..... 2/3 R; 2/9

[51] Int. Cl.[2] ..... A42B 1/08

[58] Field of Search ..... 2/3 R, 9

[56] References Cited

UNITED STATES PATENTS

| | | | |
|---|---|---|---|
| 2,535,434 | 12/1950 | Marietta | 2/9 |
| 2,664,567 | 1/1954 | Nichols | 2/3 R |
| 2,777,127 | 1/1957 | Marietta | 2/3 R |
| 3,171,133 | 3/1965 | Steffen | 2/3 R |
| 3,478,365 | 11/1969 | Varga | 2/3 R |
| 3,527,461 | 9/1970 | Prater | 2/9 X |
| 3,548,410 | 12/1970 | Parker | 2/3 R |
| 3,555,561 | 1/1971 | Neis | 2/3 R |

FOREIGN PATENTS OR APPLICATIONS

| | | | |
|---|---|---|---|
| 1,931,011 | 1/1970 | Germany | 2/3 R |

*Primary Examiner*—Alfred R. Guest

*Attorney, Agent, or Firm*—Millen, Raptes & White

[57] ABSTRACT

Various embodiments of energy absorbing, protective helmets constructed of resilient foam means covered with a tough, pliable surface coating. The helmets are adapted to be worn on a person's head and have openings therein generally conforming to a person's eyes, ears, nose, mouth and chin. In modifications of the helmet, fixed or removable transparent shield means are mounted across the front openings and hemispherical plate means can be disposed at the top of the helmet. Other modifications of the helmet provide guard means across the front openings.

8 Claims, 27 Drawing Figures

PROTECTIVE HELMET

BACKGROUND OF THE INVENTION

This invention relates to unitary, novel, protective helmets containing openings for the eyes, ears, nose, etc., capable of absorbing energy and adapted to be worn on the head of a person while engaging in various sports such as karate and related arts, boxing, etc. Furthermore, in particular modified embodiments, the helmets containing transparent shield means and/or guard means can be worn on the head of a person as protective means to prevent injuries thereto while riding a bicycle, motorcycle, and the like.

SUMMARY OF THE INVENTION

It is an object of this invention to provide a unitary, novel, protective helmet adapted to be worn on the head of a person which can easily be put on or taken off.

It is another object of this invention to provide a novel protective helmet having a simplified construction made from a resilient material having a tough, outer casing.

An additional object of this invention is to provide a novel, unitary, protective helmet comprising a novel design including openings for the eyes, nose, ears, mouth, etc.

Another object of this invention is to provide a novel, protective helmet having a simplified construction made from a resilient material having a tough, outer casing including openings for the eyes, nose, ears, mouth, etc., a transparent shield over the eyes and nose openings, and a rigid cap portion.

Another object of this invention is to provide a novel, protective helmet having easily removable transparent shield means across the front openings of the helmet.

An additional object of this invention is to provide a novel, protective helmet having guard means across the front openings of the helmet.

Generally, the unitary protective helmet is adapted to protect the face and other portions of one's head and comprises a resilient material which is capable of absorbing energy and which has a tough, outer coating or casing, preferably of plastic, which is shaped, designed, and adapted to cover the head of a person. The helmet has openings or cutout portions for various portions of the head including the eyes, ears, nose, mouth, etc. and is adapted to fit snugly and securely over a person's head and is easily put on or taken off. In one embodiment, the eye and nose openings are fitted with a permanent, rigid, transparent eye and nose shield means and the top of the helmet is fitted with a rigid cap means. In other embodiments, removable transparent shield means are provided and also guard means for the front openings.

Other features and advantages of various embodiments of the protective helmets of the invention will become apparent from the following description of the specific embodiments thereof taken in conjunction with the drawings.

DETAILED DESCRIPTION OF THE INVENTION

Figure 2:
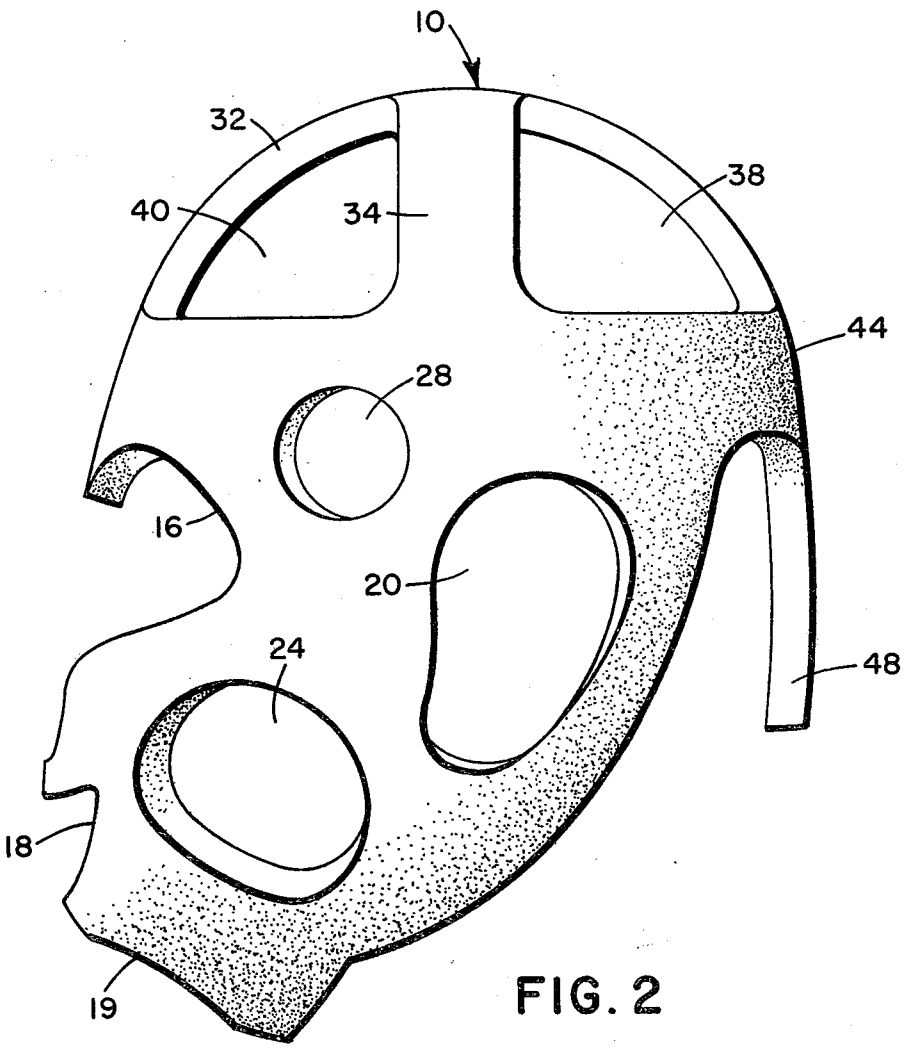
FIG. 2 is a side elevational view of the helmet of FIG. 1.
Figure 1:
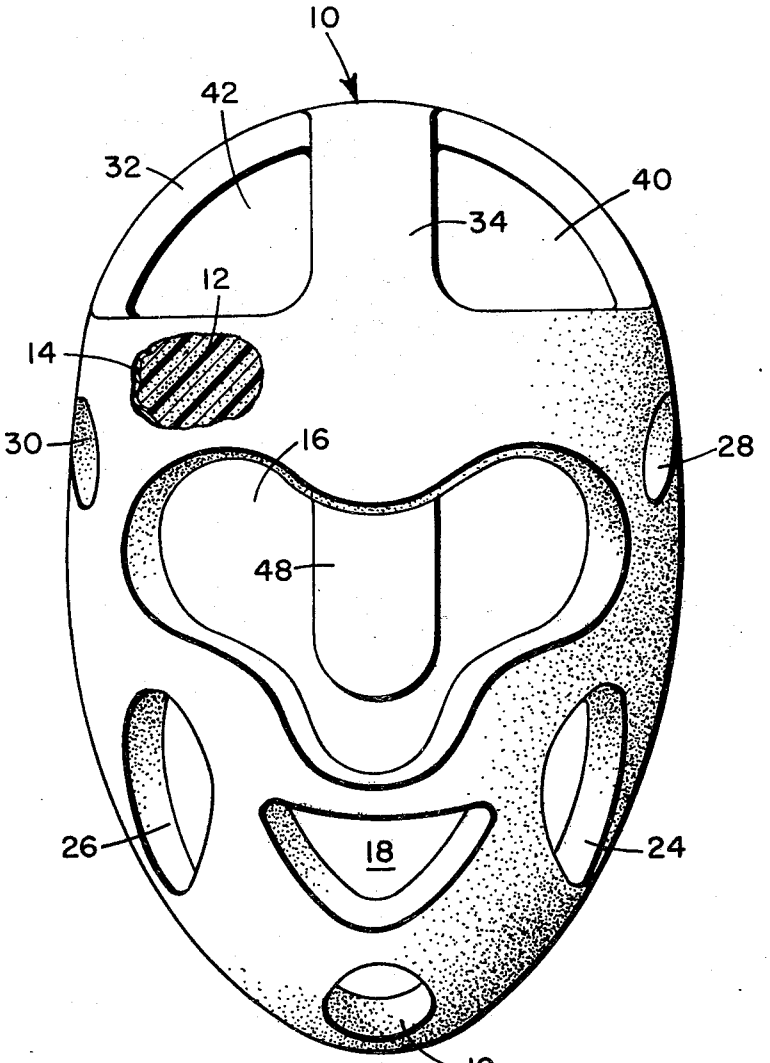
FIG. 1 is a front elevational view of one embodiment of the protective helmet of the invention with a cutaway section thereof showing the material used in the construction thereof.
Figure 3:
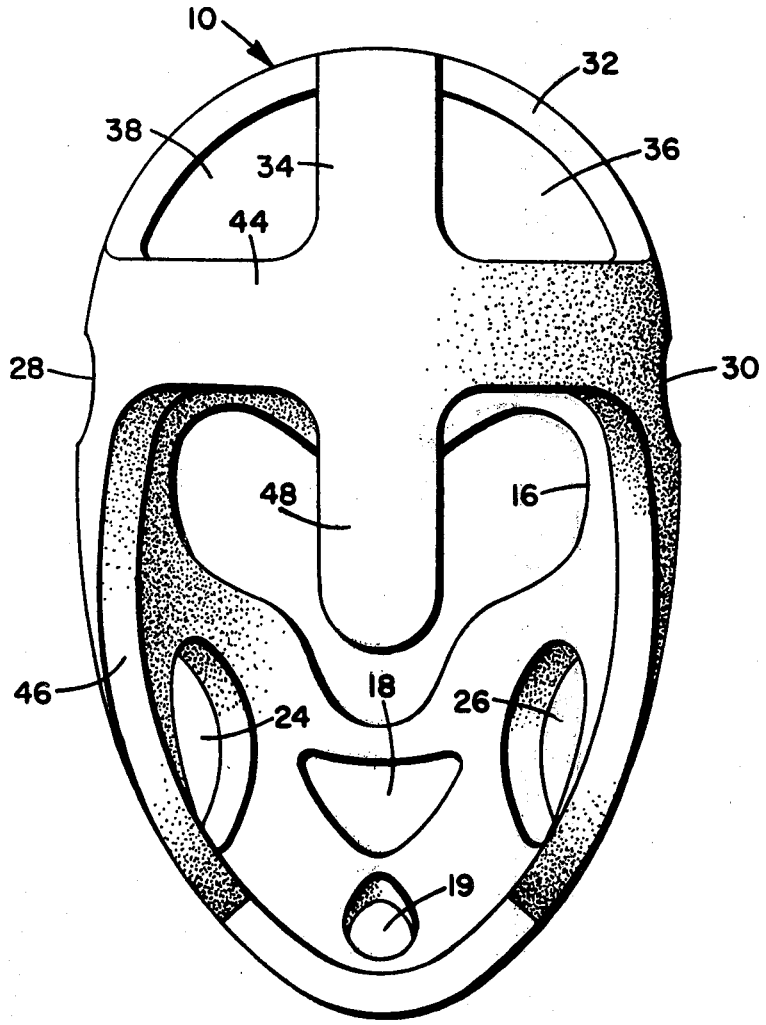
FIG. 3 is a rear elevational view of the helmet of FIG. 1.
Figure 5:
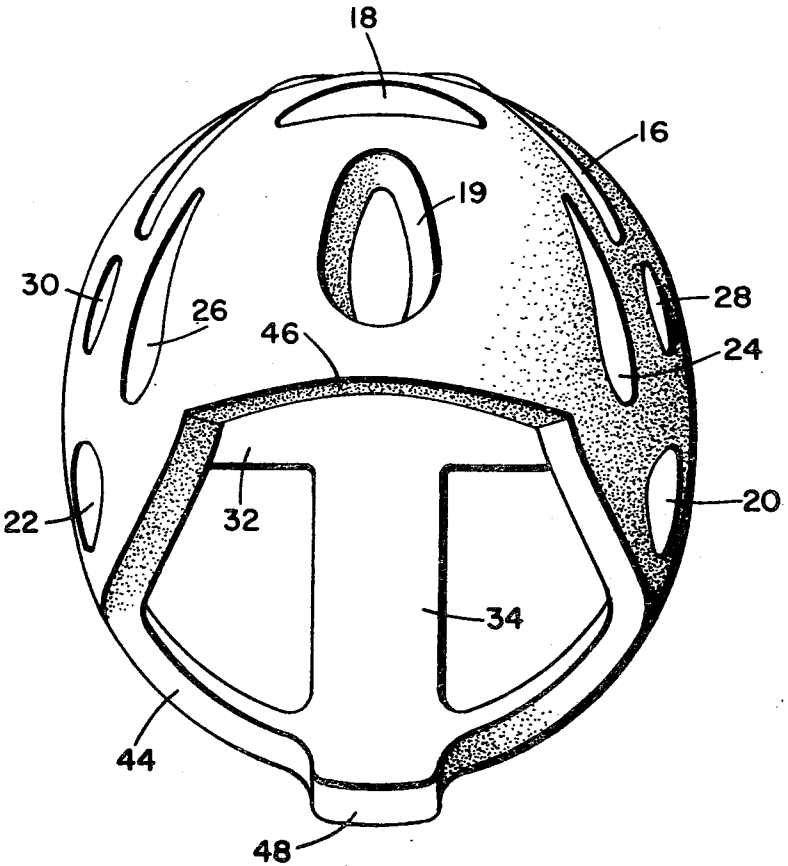
FIG. 5 is a bottom view of the helmet of FIG. 1.
Figure 4:
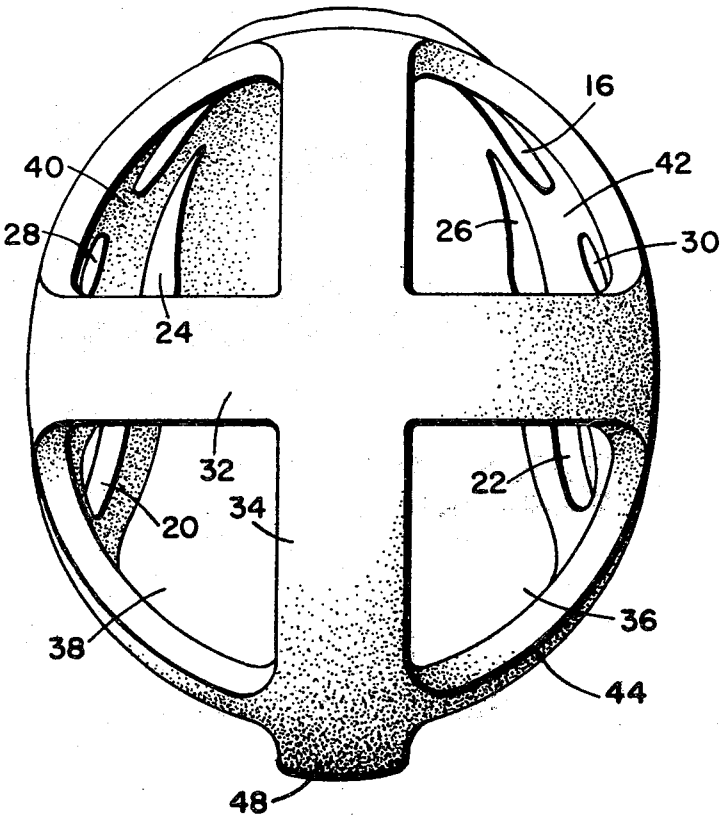
FIG. 4 is a top view of the helmet of FIG. 1.
Figure 7:
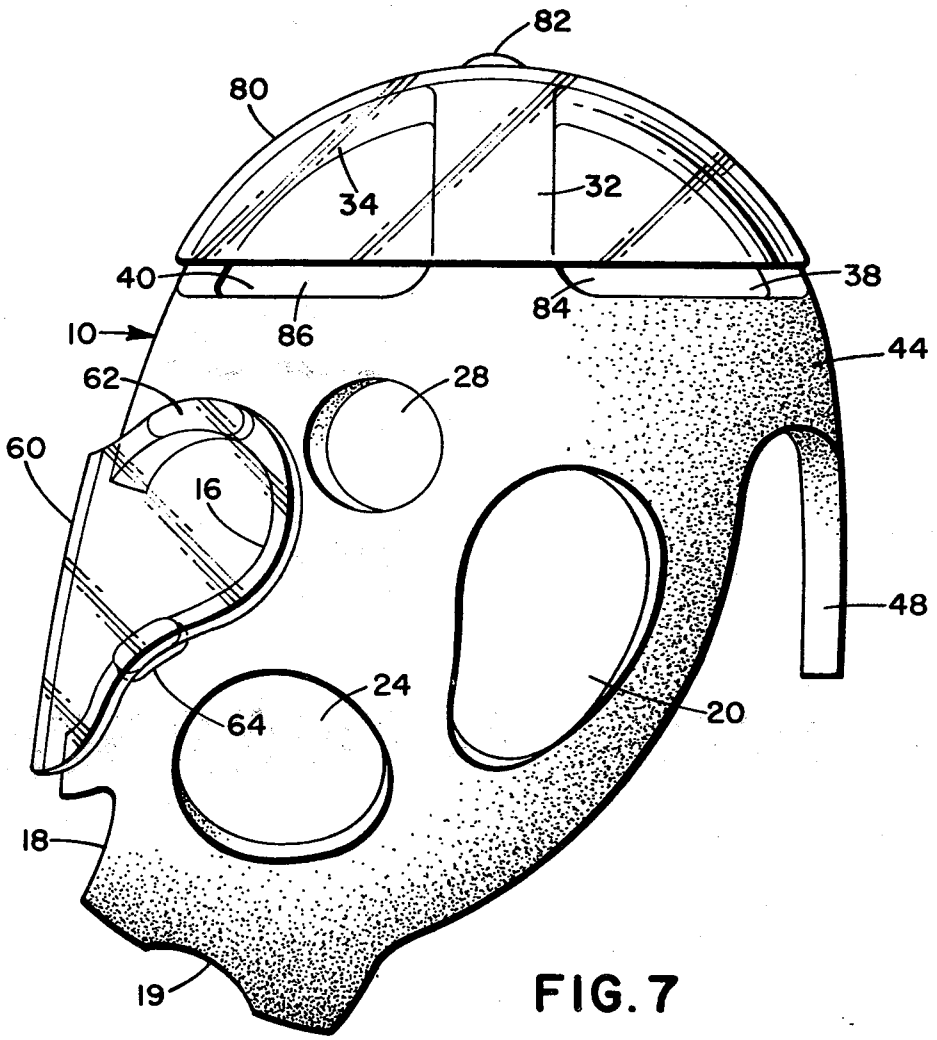
FIG. 7 is a side elevational view of the helmet of FIG. 6.
Figure 6:
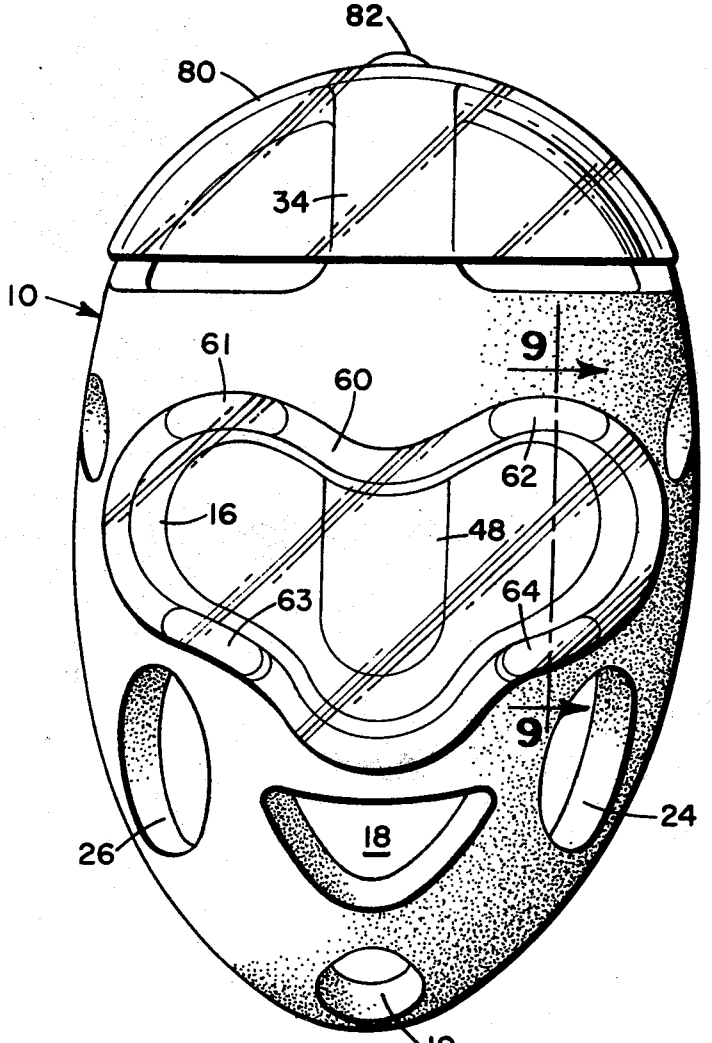
FIG. 6 is a front elevational view of a modified embodiment of the protective helmet of FIG. 1 showing a fixed transparent shield means.
Figure 8:
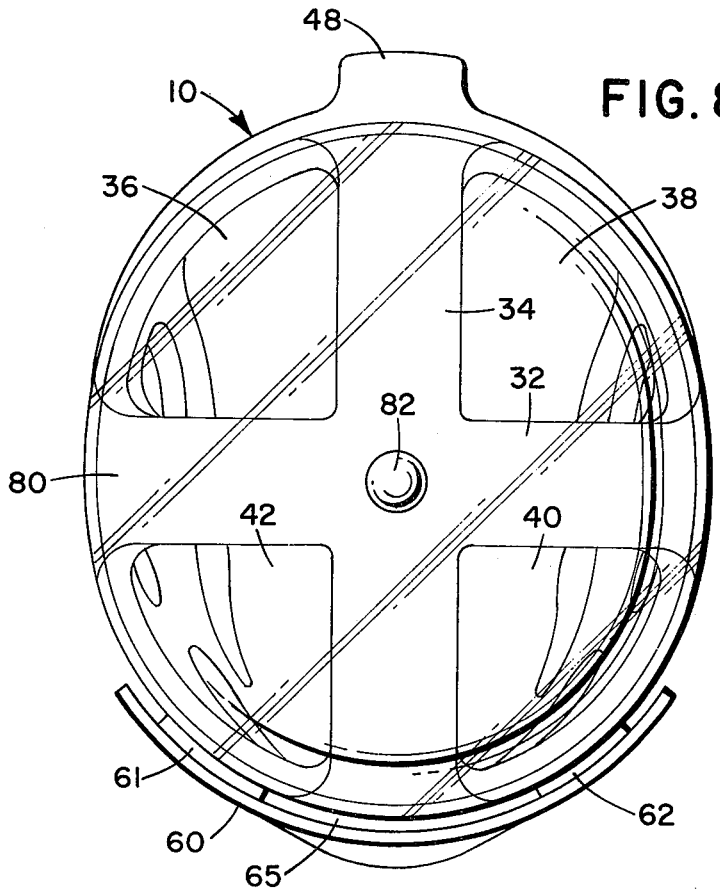
FIG. 8 is a top view of the helmet of FIG. 6.

The specific embodiment of the invention illustrated in the drawings in FIGS. 1–5 comprises a helmet device generally indicated by the numeral 10 in FIG. 1. The helmet comprises a protective member, preferably unitary, molded from a suitable resilient material 12 capable of absorbing energy, such as a plastic, i.e., polystyrene or polyurethane foam, or a rubber foam, and the like. A suitable surface coating or casing 14, preferably smooth, covers the entire resilient material throughout, and which is a tough, pliable, tear resistant, material, preferably of a suitable plastic material, or the like. The coating 14 can be formed during heating and molding of a resilient foam material to produce a fused coating thereon. Alternatively, the surface coating 14 can be applied on the resilient material by dipping or by applying and securing a coating of a suitable plastic material or the like. Materials of plastic are preferred for the coating since there are available on the market many tough, rugged, pliable materials such as polyvinylchloride, etc. However, it is also contemplated within the concept of the invention that suitable rugged leather or fabric materials, and the like, can be secured to the resilient material and used to cover the resilient material. The coating or casing used should provide a flexible, tough covering which is resistant to tearing and abrasion.

Helmet 10 comprises an overall head-shaped shell device having a plurality of cutouts or openings to accommodate the various parts of a person's head when worn. Opening 16 in the front of the helmet generally outlines the nose and eyes, and permits one to see out of the helmet as well as permitting the nose to protrude therethrough to permit breathing. Opening 18 generally outlines the mouth to permit speech and breathing therethrough. Opening 19 generally outlines a portion of the chin which can partially protrude therethrough. Similarly, openings 20 and 22 generally outline the ears for hearing purposes. Openings 24 and 26 generally outline the cheeks and are primarily for ventilation purposes as are optional ventilation openings 28 and 30.

The upper portion of the helmet (FIG. 4) covers the top of the head and comprises a pair of cross members 32 and 34 adapted to retain the helmet on the top of the person's head. Openings 36, 38, 40, and 42 in the top of the helmet provide ventilation and comfort to the wearer of the helmet while the cross members provide protection to the pate.

At the rear of the helmet, a horizontal portion 44 (FIG. 3) encompasses the rear of the head and is connected to crossmember 34 at its midpoint. Portion 44 forms a part of the upper part of the helmet which encircles the upper part of the head, i.e. around the back, above the ears and across the temple. The rear portion of the helmet has a large opening 46. A downwardly projecting portion or flap 48 extends from portion 44 at its midpoint to generally the horizontal center of the helmet, and about to the bottom of the neck of the wearer as the helmet is worn.

As seen from the above description, the helmet 10 is adapted to be worn on the head of a person to protect the head from injury while at the same time providing openings for the various parts of the head to permit seeing, talking, hearing, ventilation, etc. The helmet is easily put on or taken off. Because the helmet is not rigid, it tends to conform easily to the head and to the various features of the head of the wearer. The upper part of the head is inserted into the helmet through opening 46 and the helmet is pulled down on the back of the head by pulling flap 48 down and pulling down the front of the helmet over the face by pulling on the chin portion. Suitable adjustment of the helmet can then be made on the head with respect to the nose and eyes in relation to opening 16, with respect to the ears in relation to openings 20 and 22, etc. Removal of the helmet merely requires the pulling up of the chin portion and flap 48.

The unique construction and design of the helmet of FIGS. 1–5 provides protection to the head when one is engaging in various competitive, combative, type sports such as boxing, hockey, lacrosse, etc., as well as the martial arts such as karate, kung fu, etc.

The embodiment described above and those to be described hereinafter of the protective helmet of the invention also find use as protective means for motorcycle and bicycle riders, etc. in order to aid in protecting the head from injuries during accidents, etc. Thus, the resilient material, as well as the tough outer casing material, provide energy absorbing means to cushion and protect the head of a person. Thus, as shown in FIGS. 6–9, the modification of the helmet 10 depicted comprises additional protective features. The helmet of FIGS. 6–9 is in all respect similar in construction as that described in FIGS. 1–5. However, in this modification thereof, a generally curved, transparent shield 60 is disposed across the eye and nose opening 16 and a generally hemispherical plate 80 is disposed around the top of the helmet.

Figure 9:
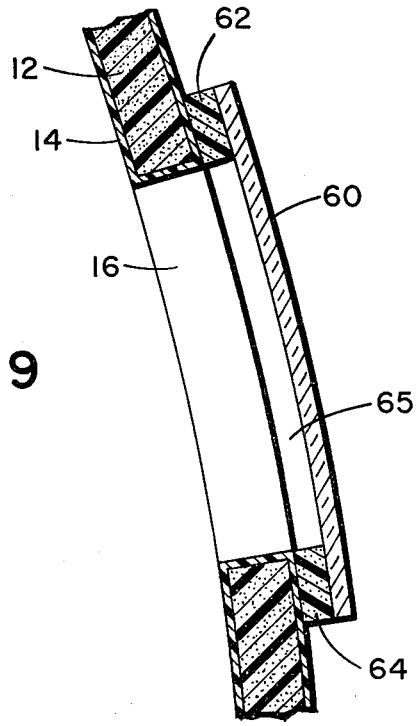
FIG. 9 is a section taken along line 9—9 of FIG. 6.

Shield 60 generally conforms in shape to the opening 16 and overlaps the opening around its outline to about one-fourth to one-half an inch as shown in FIG. 9. The shield is retained and spaced from the helmet and opening by means of a suitable number of spacer means such as 61, 62, 63 and 64. The spacer means are adapted to be secured as by gluing, etc. to the helmet. The shield can also be glued, etc. to the spacer means to provide for permanent attachment of the shield to the helmet across the opening 16.

The shield being spaced from the surface of the helmet provides means for air passage into opening 16, such as through space 65 (FIG. 9). The shield, being transparent, permits the wearer to see as well as permitting breathing through opening 16, while at the same time protecting the eyes and nose from injury and also deflecting air, dust, etc. The shield can be constructed of any suitable rigid or semi-rigid transparent material such as a plastic material or the like.

The protective plate 80 is adapted to be disposed around the top of the helmet to protect the upper part of the head. Plate 80 is generally hemispherical in shape and is adapted to cover open sections 36, 38, 40 and 42, and can be secured thereto at the top portion of the helmet by any suitable means such as by gluing, bolt means 82, as shown, etc., and can be permanently mounted or detachably mounted. The plate 80 is designed to substantially cover the sections 36, 38, 40, and 42, but not completely to provide passageways such as 84 and 86 for air ventilation purposes. Plate 80 can be constructed of any suitable rigid or semi-rigid material such as metal, plastic (transparent, if desired) or the like.

Figure 10:
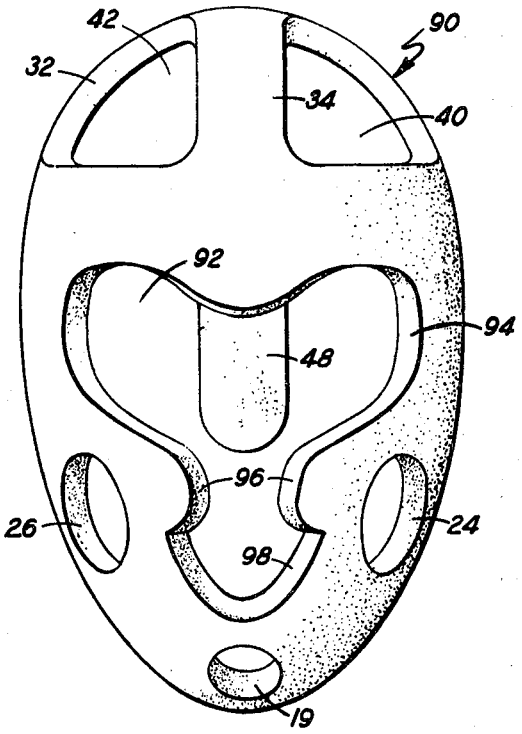
FIG. 10 is a front elevational view of a second embodiment of the protective helmet of the invention.
Figure 11:
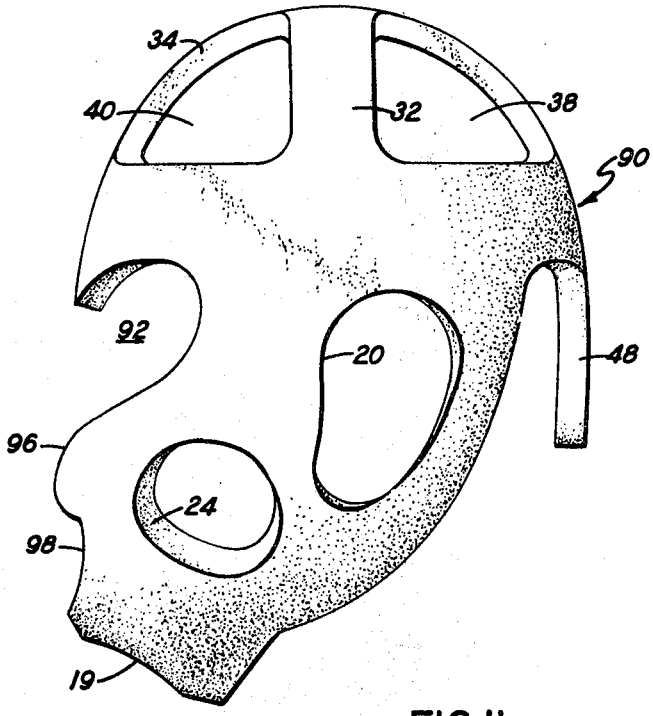
FIG. 11 is a side elevational view of the helmet of FIG. 10.

In FIGS. 10 and 11, a second embodiment of the protective helmet of the invention is depicted. The numeral 90 generally denotes a helmet device substantially the same in all respects in construction and material as the helmet embodiment 10 shown in FIGS. 1–5. However, the helmet device 90 is modified to provide a continuous opening 92 in the front of the helmet which generally conforms to and outlines the nose, eyes and mouth. Opening 92 permits one wearing the helmet to see out of the helmet in the portion 94 as well as having the nose protrude therethrough in portion 96. In addition, the opening 92 at portion 98 generally outlines the mouth and permits speech and breathing therethrough. Thus, opening 92 being continuous in design and open in the portion 92 provides a somewhat greater flexibility in helmet 90 than that provided by separate openings 16 and 18 of helmet 10. Helmet 90 as designed does not contain the ventilation openings such as 28 and 30 shown optionally in helmet 10. Thus, with opening 92, adequate ventilation is provided in helmet 90. However, if desired, openings 28 and 30 can be provided in helmet 90.

Figure 13:
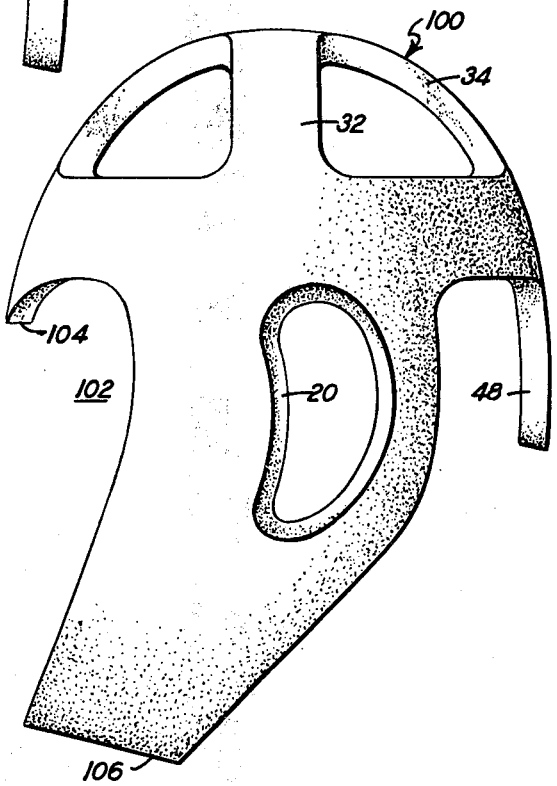
FIG. 13 is a side elevational view of the helmet of FIG. 12.
Figure 12:
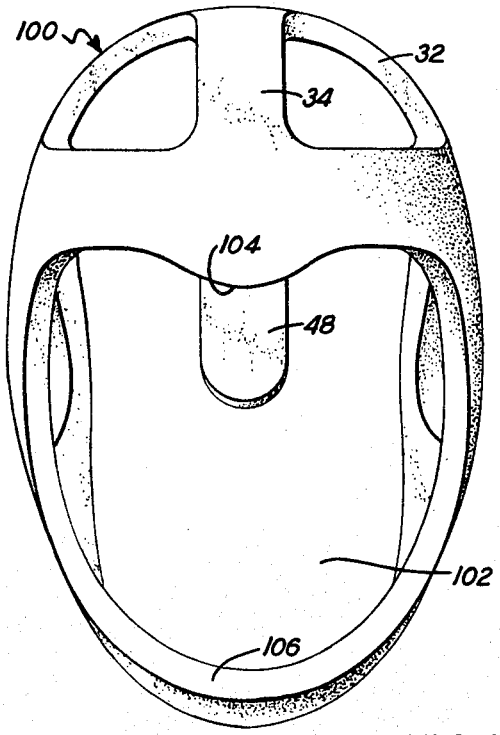
FIG. 12 is a front elevational view of a third embodiment of the protective helmet of the invention.
Figure 16:
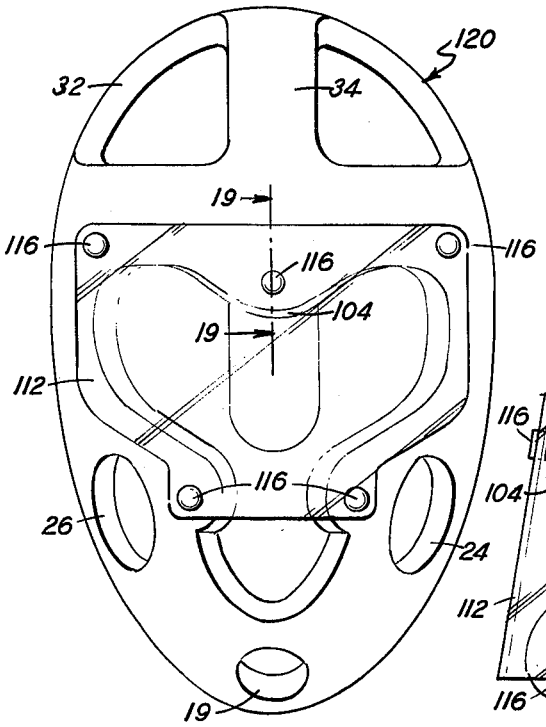
FIG. 16 is a front elevational view of a modified embodiment of the protective helmet of FIG. 10 showing removable transparent shield means.
Figure 17:
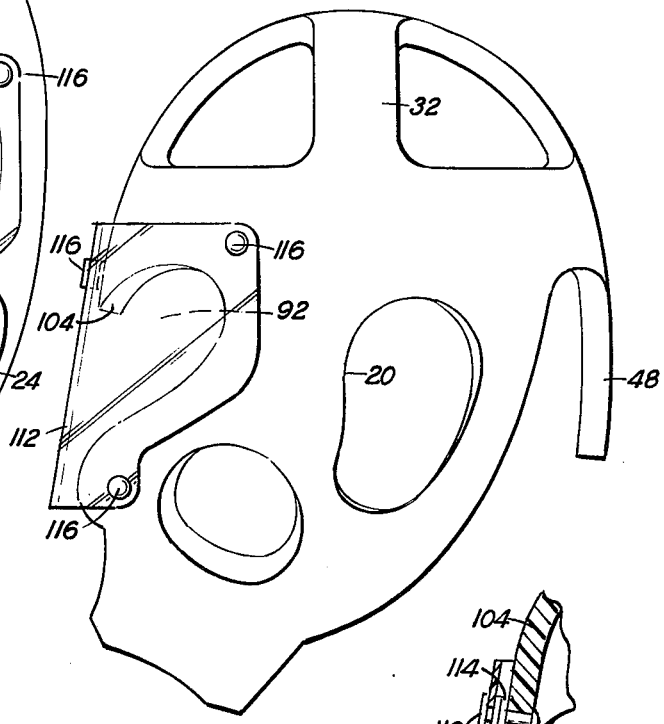
FIG. 17 is a side elevational view of the helmet of FIG. 16.

In FIGS. 12 and 13, a third embodiment of the protective helmet of the invention is depicted. The numeral 100 generally denotes a helmet device substantially the same in all respects in construction and material as the embodiment shown in FIGS. 1–5. However, helmet device 100 is modified to provide a large continuous opening 102 in the front of the helmet which generally conforms to and outlines the portion of a person's face encompassing the eyes, nose, mouth and part of the chin. Portion 104 of the helmet 100 is designed to cover only the upper portion of the nose, similarly as in helmets 10 and 90. Portion 106 is designed to pass under the chin of the wearer and aids in retaining the helmet on the person's head. Opening 102 is designed to permit the facial features to be more exposed and provides greater flexibility in the use of helmet 100 than that provided in helmets 10 and 90.

Figure 14:
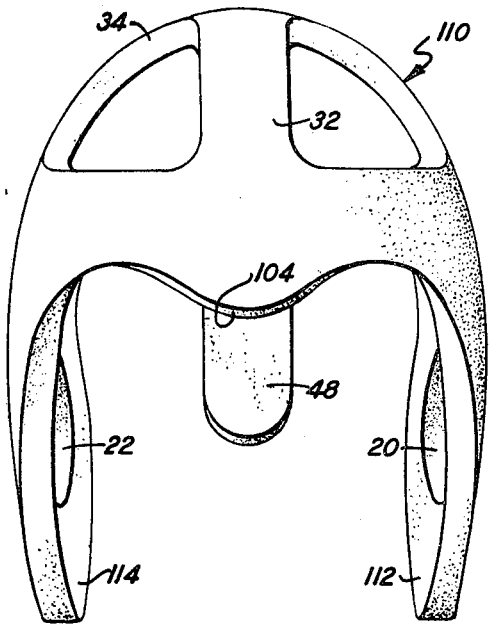
FIG. 14 is a front elevational view of a fourth embodiment of the protective helmet of the invention.
Figure 15:
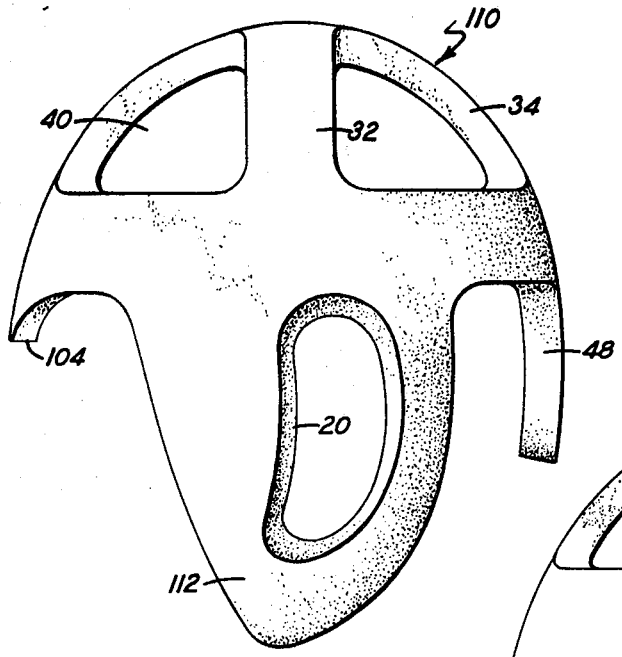
FIG. 15 is a side elevational view of the helmet of FIG. 14.

In FIGS. 14 and 15, a fourth embodiment of the protective helmet of the invention is depicted. The numeral 110 generally denotes a helmet device substantially the same in all respects in construction and material as the embodiment shown in FIGS. 1–5. However, the helmet device 110 is modified to eliminate the lower portion which would cover the chin and lower portions of a person's head. Thus, helmet device 110 comprises ear openings 20 and 22 inside portions 112 and 114, respectively. Portion 104, of helmet 110, is designed to cover only the upper portion of the nose as in helmet 10 and the others. Side portions 112 and 114 generally cover and protect the side of the head. Helmet 110 is designed and adapted to be easily put on and taken off with the aid of flap 48 as in the previous embodiments.

In FIGS. 16–19, a modification of the second helmet embodiment 90 of FIGS. 10 and 11 is shown. The numeral 120 generally denotes a helmet device substantially the same in construction and material as the helmet embodiment 90. However, the helmet device 90 is modified to provide a removable protective transparent shield 112. Shield 112 is preferably a rigid or semi-rigid transparent plastic material and the like and is designed to cover opening 92 across portions 94 and 96. Portion 98 outlining the mouth is not covered by shield 112 to permit breathing and speech. Shield 112 is curved horizontally across opening 92 as particularly shown in FIGS. 17 and 18 to conform to and accommodate the front curvature of the helmet and head.

Figure 19:
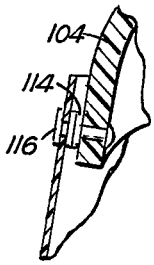
FIG. 19 is a partial section taken along line 19—19 of FIG. 16.
Figure 18:
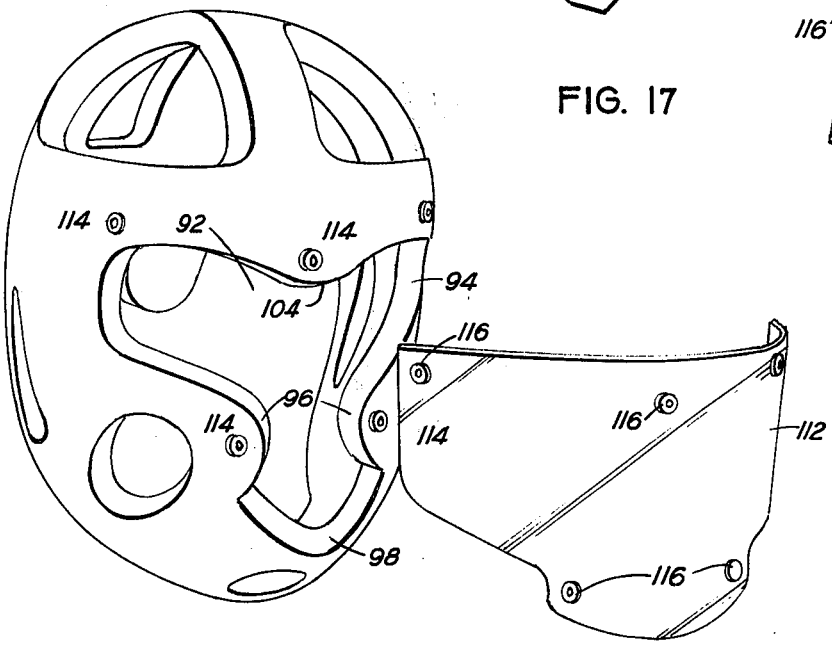
FIG. 18 is a perspective exploded view of the helmet of FIG. 16.

Shield 112 is designed to be easily secured and removed from helmet 110. The shield and helmet are provided with a number of conventional snap devices 114 and 116. Each step member 114 is permanently disposed through the thickness of the body of the helmet as shown in FIG. 19. Similarly, snap member 116 is permanently disposed through the shield 112. Thus, the shield can be easily secured to the helmet by mating the respective snap members 114 and 116. Removal is accomplished by removal of snap portions 116 from snap portions 114.

Figure 20:
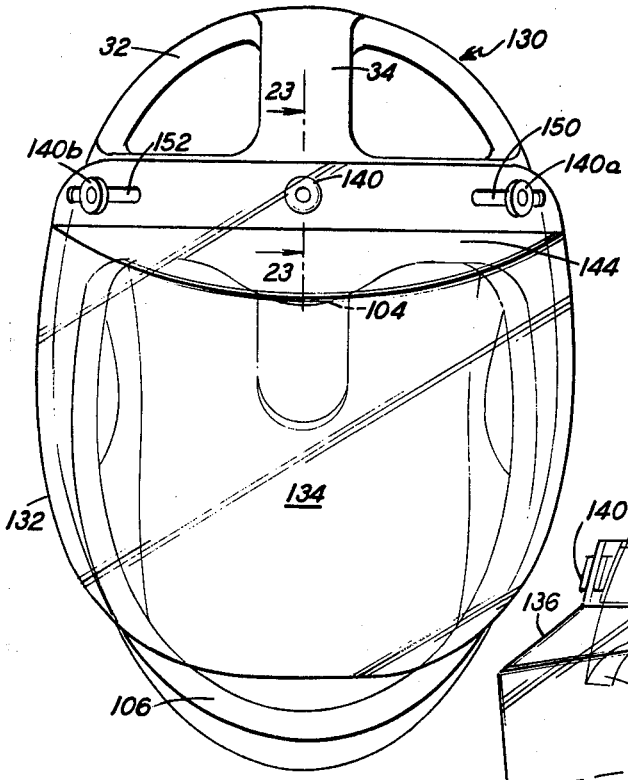
FIG. 20 is a front elevational view of a modified embodiment of the protective helmet of FIG. 12 showing removable transparent shield means.
Figure 23:
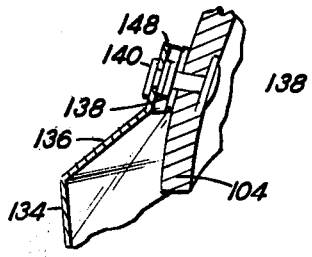
FIG. 23 is a partial section taken along line 23—23 of FIG. 20.
Figure 21:
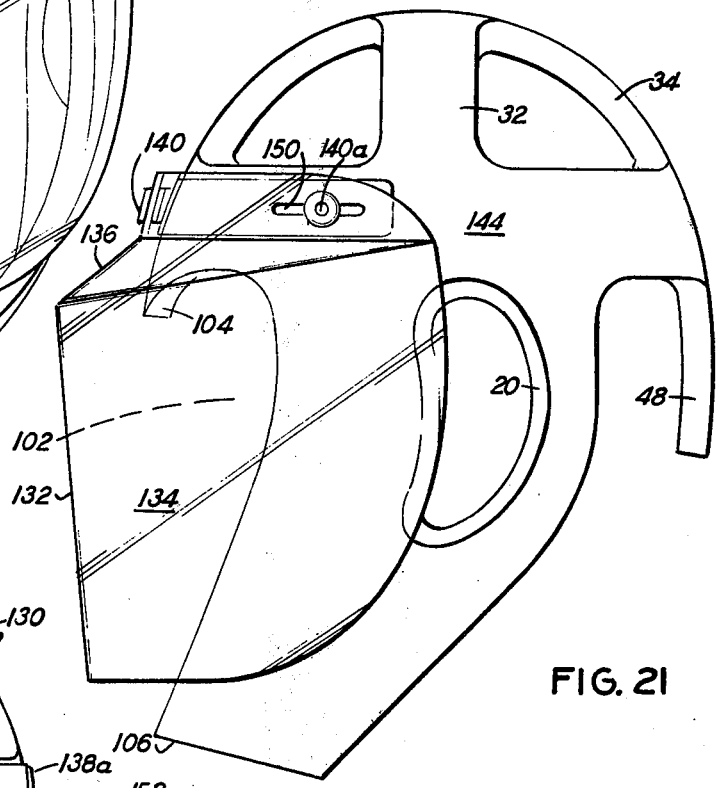
FIG. 21 is a side elevational view of the helmet of FIG. 20.
Figure 22:
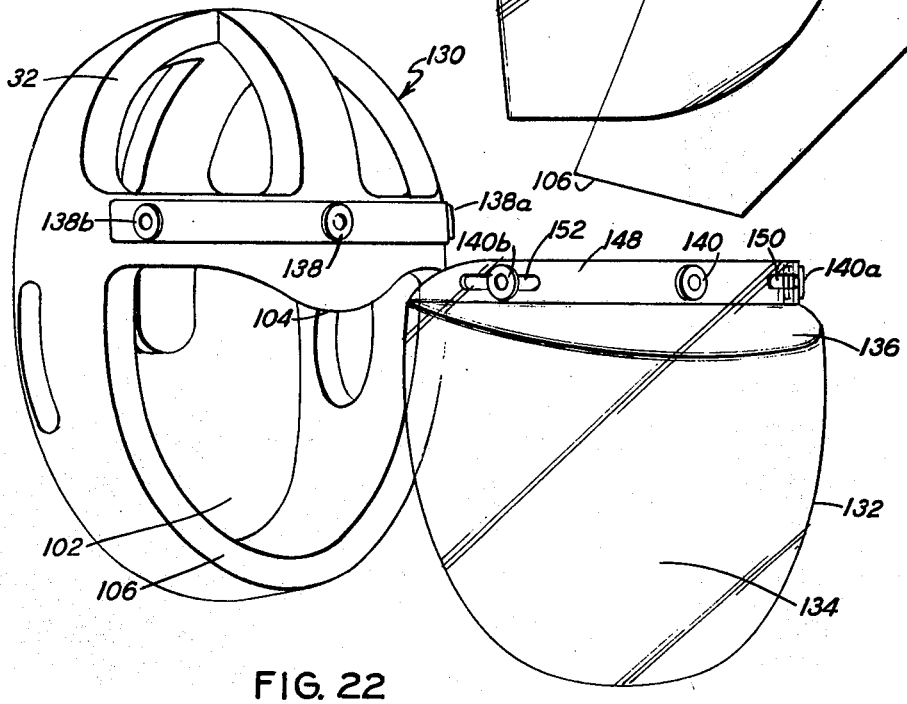
FIG. 22 is a perspective exploded view of the helmet of FIG. 20.
Figure 24:
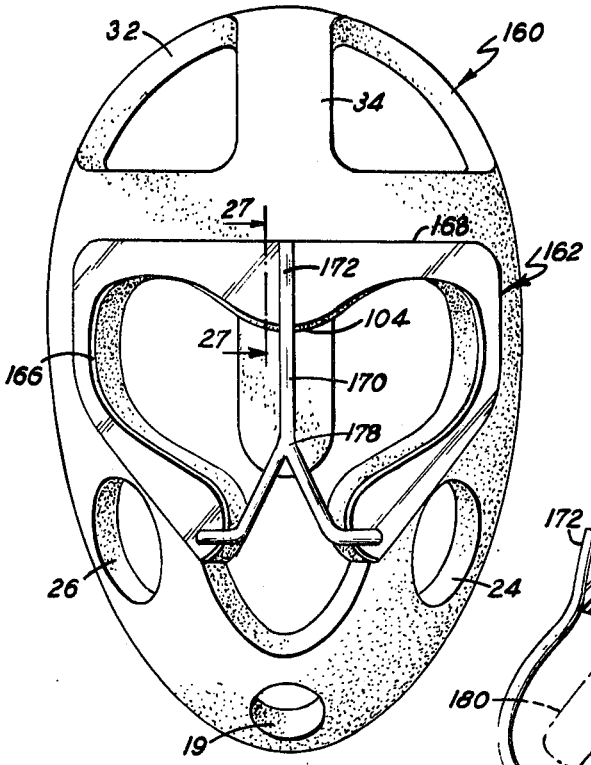
FIG. 24 is a front elevational view of another modified embodiment of the protective helmet of FIG. 10 showing guard means.
Figure 27:
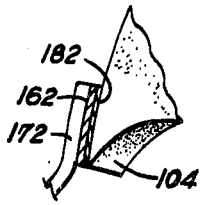
FIG. 27 is a partial section taken along line 27—27 of FIG. 24.
Figure 25:
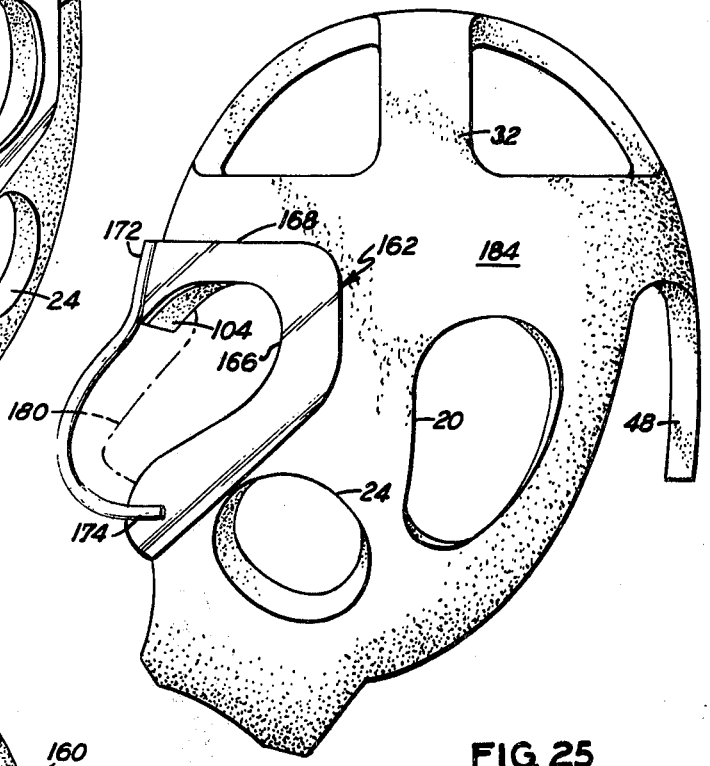
FIG. 25 is a side elevational view of the helmet of FIG. 24.

In FIGS. 20–22, a modification of the third helmet embodiment 100 of FIGS. 12 and 13 is shown. The numeral 130 generally denotes a helmet device substantially the same in construction and material as the helmet embodiment 100. However, the helmet device 100 is modified to provide a removable protective transparent shield 132. Shield 132 comprises a rigid or semi-rigid transparent plastic material and the like and is adapted to almost completely cover opening 102 except a portion of the opening near portion 106 of the helmet to permit speech and breathing. Shield 132 has a generally curved horizontally portion 134 across opening 102 as particularly shown in FIGS. 21 and 22 to conform to and accommodate the front curvature of the facial features. The shield comprises a forwardly protruding portion 136 contiguous with portion 134. In this arrangement the shield portion 134 is set forward from the face.

The shield 132 can easily be secured and removed from helmet 130 by means of a number of conventional snap devices 138 and 140. Snap members 138, **138*a* and 138*b* are permanently contained on a rigid curved plate member 142 constructed of plastic, metal, or the like. Plate member 142 is permanently secured to the front of the helmet on portion 144** encircling the top of the head.

Shield 132 comprises an upwardly extending section 148 which contains at either side elongated horizontal slots 150 and 152. Snap member 140 is fixedly disposed at the midpoint of section 148 and is adapted to snap together with snap member 138. Snap members **140*a* and 140*b* are disposed within slots 150 and 152, respectively, and can be moved back and forth within the slots. Snap members 140*a* and 140*b* are adapted to snap together with snap members 138*a* and 138*b*, respectively. The shield 132 is easily featured to the helmet 130 by initially engaging snap member 140 to snap member 138, and thereafter adjusting snap members 140*a* and 140*b* in the slots to conform to snap members 138*a* and 138*b***, respectively, and snapping them together.

Figure 26:
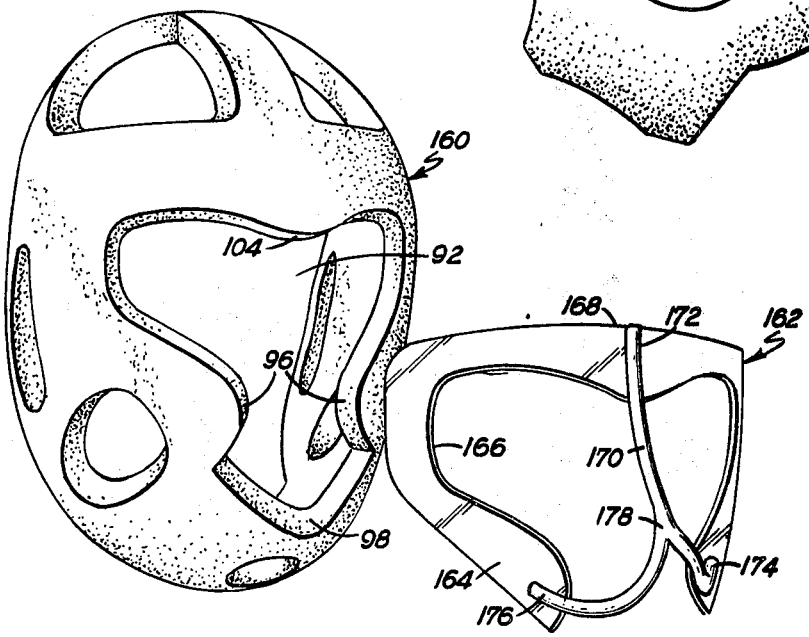
FIG. 26 is a perspective exploded view of the helmet of FIG. 24.

In FIGS. 23–27, another modification of the second helmet embodiment 90 of FIGS. 10 and 11 is shown. The numeral 160 generally denotes a helmet device substantially the same in construction and material as the helmet embodiment 90. However, the helmet device 160 is modified to provide an integral, fixed, rigid guard member 162 (FIG. 26). Guard member 162 is constructed of a rigid, strong, plastic material, metal, or the like. Guard member 162 is adapted to be permanently secured to the periphery of opening 92 of helmet 160.

Guard member 162 comprises a curved plate member 164 having an inner periphery 166 conforming in outline to the opening 92 of the helmet. The lower portion of guard member 162 only extends to portions 96 of the helmet. The outer periphery 168 of the guard member generally parallels the inner periphery 166 and has a width varying between one-fourth to one-half an inch to give it suitable strength. A curved, inverted, Y-shaped, forwardly-protruding rigid member 170 is integral with plate member 164 at points 172, 174, and 176, at which points plate member 164 has greater widths. The rigid Y-shaped member can be tubular or flat in its cross section. Portion 178 is designed to protrude forward the greatest amount to provide sufficient clearance and protection for the nose 180 of a person.

Guard member 162 is permanently secured to the front portion of helmet 160 by any suitable means such as an adhesive 182 securing plate member 164 thereto. Although the guard member 162 is depicted as conforming in overall shape to the opening 92, it is also contemplated within the concept of this invention that the guard member can comprise a rigid extension of the plate member 164 which encircles the helmet around portion 184 and the back thereof to provide additional strength and protection thereto.

The various embodiments and modifications of the protective helmets described above have various specific uses. Thus, helmets 10, 90, 100, 110, and 160 find particular use in competitive contact sports wherein portions of the head are to be protected against blows, chops, hand-held weapons, etc. The modifications of the helmets wherein transparent shields are provided find use for riders of vehicles such as motorcycles, bicycles, and the like, wherein protection of the face against wind, objects, and protection during possible accidents is obtained. In all the various described helmets, their primary purpose is for the protection of the various parts of the head and face against injury by providing energy-absorbing material in the helmet.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A protective helmet adapted to be worn on a person's head and capable of absorbing energy and generally conforming to the shape of a person's head, comprising resilient foam means covered with a tough, pliable surface casing, openings in said helmet generally conforming to the person's ears and chin, one large opening outlining the face portion of the head including the eyes, nose, mouth and chin, the rear of said helmet being generally open and including a flap member adapted to protect the rear of the head and to aid in putting on and taking off of said helmet.

2. The helmet of claim 1 wherein the upper part of said helmet has a pair of cross-members adapted to retain the helmet on a person's head and openings for ventilation purposes.

3. The helmet of claim 1 wherein said helmet has additional ventilation openings.

4. The helmet of claim 1 wherein said resilient material is a plastic foam and said casing is a tough plastic material.

5. The helmet of claim 1 wherein a curved transparent shield is permanently disposed across said large opening and spaced therefrom by spacer means.

6. The helmet of claim 1 wherein said helmet comprises a hemispherical plate means disposed around the top portion thereof.

7. The helmet of claim 6 wherein said plate means is disposed around openings in the top portion of said helmet with provision for ventilation to said openings.

8. The helmet of claim 1 wherein a curved transparent shield is detachably mounted across said large opening.

* * * * *